US008784609B2

(12) United States Patent
Azer

(10) Patent No.: US 8,784,609 B2
(45) Date of Patent: Jul. 22, 2014

(54) FIBRE FURNISH

(75) Inventor: Ramy Abraham Azer, Thebarton (AU)

(73) Assignee: Papyrus Technology Pty Ltd., Adelaide (AU)

( * ) Notice: Subject to any disclaimer, the term of this patent is extended or adjusted under 35 U.S.C. 154(b) by 203 days.

(21) Appl. No.: 13/141,703

(22) PCT Filed: Dec. 24, 2009

(86) PCT No.: PCT/AU2009/001703
§ 371 (c)(1),
(2), (4) Date: Jul. 25, 2011

(87) PCT Pub. No.: WO2010/071945
PCT Pub. Date: Jul. 1, 2010

(65) Prior Publication Data

US 2012/0152473 A1 Jun. 21, 2012

(30) Foreign Application Priority Data

Dec. 24, 2008 (AU) ..... 2008906622

(51) Int. Cl.
*D21H 11/12* (2006.01)

(52) U.S. Cl.
CPC ..... *D21H 11/12* (2013.01)
USPC ..... 162/98; 162/99

(58) Field of Classification Search
CPC ..... D21H 11/12
USPC ..... 162/98, 99
See application file for complete search history.

(56) References Cited

U.S. PATENT DOCUMENTS

| | | | | |
|---|---|---|---|---|
| 2,045,096 | A * | 6/1936 | Osborne | 162/100 |
| 5,958,182 | A * | 9/1999 | Hondroulis et al. | 162/24 |
| 6,506,307 | B1 * | 1/2003 | Hondroulis et al. | 210/671 |

FOREIGN PATENT DOCUMENTS

| | | | |
|---|---|---|---|
| BR | PI 0601860 | | 1/2008 |
| CN | 1472372 | | 2/2004 |
| GB | 2 283 989 | | 5/1995 |
| JP | 56-073191 | | 6/1981 |
| JP | 2002-339281 | | 11/2002 |
| WO | 2006-029469 | A1 | 3/2003 |
| WO | WO 2007144588 | A1 * | 12/2007 |
| WO | 2008-003121 | A1 | 1/2008 |

OTHER PUBLICATIONS

TAPPI, TAPPI T 233 cm-95 Fiber length of pulp by classification, 1998, TAPPI.*
Derwent Summary of CN 101736407, 2011, Derwent, Derwent ACC-No. 2010-J38794.*
International Search Report for PCT/AU2009/001703 dated Feb. 8, 2010.
First Notification of Office Action. Chinese Patent Application No. 200980157486.7, issued Oct. 16, 2012.
2nd Notification of Office Action, Chinese Patent Application No. 200980157486.7, issued Apr. 19, 2013.
Extended European Search Report, European Patent Application No. 09833945.1, issued Apr. 12, 2012.

* cited by examiner

*Primary Examiner* — Anthony Calandra
(74) *Attorney, Agent, or Firm* — Nixon Peabody LLP; Jeffrey L. Costellia

(57) ABSTRACT

Fiber furnish for use in the manufacture of paper and paper-based products, the fiber furnish consisting essentially of plant petiole tissue, wherein substantially longitudinally aligned petiole fibers have been cut generally laterally to form fibers with a fiber length distribution such that at least 95% of the fibers have substantially the same predetermined fiber length.

13 Claims, 7 Drawing Sheets

FIBRE FURNISH

This international patent application claims priority from Australian provisional patent application 2008906622 filed on 24 Dec. 2008, the contents of which are to be taken as incorporated herein by this reference.

FIELD OF THE INVENTION

The present invention relates to material used in the making of paper and paper-based products such as newsprint, copy paper, tissue paper, cardboard and construction and packaging paper. In particular, the present invention relates to material commonly referred to in the art as "furnish", being that which is used as feedstock in, for example, a kraft paper making process. Ordinarily, this furnish will be a pulp, normally in the form of a cellulosic fibrous material produced by a chemical or mechanical pulping process.

The fibre furnish of the present invention will also find use in other products typically manufactured from cellulosic fibrous material, such as panel boards, particle board, medium or high density fibre boards (MDF and HDF), floor base panels and wall and ceiling panels, and the like. These products are often referred to as "engineered woods", based on timber being the normal source of the fibre furnish.

BACKGROUND OF THE INVENTION

The following discussion of the background to the invention is included to explain the context of the invention. This is not to be taken as an admission that any of the material referred to was published, known, or part of the common general knowledge (in any country) as at the priority date of any of the claims. Furthermore, much of the following description is provided with the production of paper or a paper-based product as the context. This is done for ease of description and is not to be regarded as limiting in relation to final uses for the fibre furnish.

Herbaceous plants have been relied upon as a feedstock for paper for thousands of years. However, for at least the last century, wood has become the primary fibre source for paper feedstock, and pulping has become by far the major fibre processing technique. Indeed, the demand for pulp over that period of time has given rise to several of the world's more prominent and controversial environmental and ecological issues.

It is accepted that the conversion of wood into paper requires the use of heavy-duty industrial processes, typically requiring very large energy inputs, high volumes of process water, and having high waste levels, and generally using chemicals that give rise to difficult and sometimes hazardous disposal and recycling requirements. Also, the pulping process, be it chemical or mechanical, is often unable to adequately control the condition and geometry of fibres in the furnish produced, at least to the extent that downstream papermaking processes regard as desirable.

Thus, there has been a growing interest in developing alternative fibre crops for use in the production of paper, and alternative technologies to replace pulping. One source of fibre that has been recognised as a suitable alternative to wood is the banana plant.

The banana plant is a large perennial herb with tall aerial shoots that arise from swollen, fleshy corms (an underground rhizome). The banana plant's petioles are arranged spirally in the aerial shoots, and their long overlapping pulvini (basal enlargements) form the outer portion of a stout, trunk-like pseudostem, through the centre of which the terminal inflorescence grows, forming an inner portion often referred to as a core. Higher up, the petioles bend away from the pseudostem and bear large oval blades (leaves) at an oblique angle.

Each pseudostem can grow to heights normally in the range of 3 to 8 meters over a 9 to 18 month period. When mature, each pseudostem will thus comprise a soft but dense core, surrounded by an outer portion that is tougher but is less dense.

Commercially planted banana plants typically only have 1 to 2 year life-spans, as banana plants only flower (and produce bananas) once, following which the leaves and pseudostem start to die. This usually requires their removal in some manner, such as by simply being cut down, allowing regrowth of a new pseudostem from the rhizome and the commencement of a new reproductive phase.

With annual production in 2002 of about 68 million tonnes of bananas (more than two thirds coming from within India, Brazil, China, Ecuador and the Philippines), it has been recognised that banana pseudostems represent a potentially valuable renewable resource, one which has been traditionally under-utilised and historically economically ignored by banana growers. With this in mind, there have been numerous attempts to use the pseudostems for the production of paper, due to the beneficial properties and qualities of the fibre in the pseudostems.

However, in a paper titled "Banana Stem Fibre for Papermaking" by S. K. Singhai, J. K. Garg and B. Biswas for the *Indian Pulp and Paper Journal*, August-September 1975, 30(2), pp 13 to 15, the situation at that time was summarised as "The pulping and papermaking qualities of banana (*M. sapientum* and *M. paradisica*) stem fibre have been examined. From the available information given in this paper, it is to be considered that neither technically nor economically the use of banana stem fibre is a feasible proposition." Thus, at least in the mid 70's, no sensible approach had yet been developed for the use of these materials for paper production.

Since then, it has continued to be recognised that banana pseudostem fibres should have suitable properties for paper production. In a paper titled "Plantain (*M. Paradisiaca* L) Pseudostem; A Fibre Source For Tropical Countries" by Nicholas A Darkwa of the Forestry Research Institute of Ghana, published in *Book 2, TAPPI Proceedings,* 1998 for the 1998 Pulping Conference in Montreal Quebec, it was concluded that " . . . tropical countries that are deficient in long-fibred material for their pulp and paper production can utilise the pseudostems of plantain and banana for such purposes."

Indeed, several attempts have been made to use banana plant refuse (predominantly pseudostems, which includes petioles and cores, and also leaves, immature inflorescence and unused bananas) in existing or modified paper pulping processes—see U.S. Pat. No. 5,958,182 for a short summary of some such processes.

However, such refuse commonly has an extremely high water and natural latex content, and includes numerous resinous and gummy substances that are difficult to handle and process. In order to produce workable fibres having desirable characteristics for paper-making, it has proven necessary to extract these fluids and, in particular, wash out the latex and other natural resinous substances. This has proven to be technically difficult, and has generally made the pulping of banana refuse for the production of paper uneconomic, particularly for bulk paper supplies and for anything other than boutique or artistic papers. It has also generally presented the manufacturers with significant chemical waste disposal issues.

In Australia, while it has been reported that a good quality paper can be made in low volume by combining and pulping banana fibre and betel nut husk (*Areca catechu* L.), Australian investigators have nonetheless concluded that the yield of banana fibre is too low for extraction in pulping processes to be economical. Indeed, in one Australian report, it was reported that only 1 to 4 oz (28-113 g) of suitable fibre could be obtained from 40 to 80 lbs (18-36 kg) of green pseudostems from a pulping process. Thus, 132 tonnes of green pseudostems would yield only 1 tonne of paper. The conclusion was thus that the pseudostem would have much greater value as organic matter chopped and left in the field to fertilise subsequent crops, which indeed is where the Australian banana growing industry finds itself today.

There have also been suggestions for the use of banana plants without pulping, such as the processes described in International patent publication WO2006/029469 (in the name of Papyrus Australia Limited) and in U.S. Pat. No. 1,981,883 (to Charles O Tappan). The processes described in both documents aim to avoid the pulping problem by providing sheets of fibres directly from the pseudostems of banana plants, with sheets subsequently being used in, for example, laminating processes.

The present invention seeks to provide a further alternative to the use of wood in traditional pulping processes and to provide an improved fibre furnish.

SUMMARY OF THE INVENTION

The present inventors have sought to provide such a further alternative by making use of plant petioles, such as petioles from banana plants in the family Musaceae, for the production of a fibre furnish having a narrow fibre length distribution, ideally in a manner that is both technically simple and reasonably economic, so as to permit relatively high volume paper production therefrom.

The present invention provides a fibre furnish for use in the manufacture of (amongst other things) paper and paper-based products, the fibre furnish consisting essentially of plant petiole tissue, wherein substantially longitudinally aligned petiole fibres have been cut generally laterally to form fibres with a fibre length distribution such that at least 95% of the fibres have substantially the same predetermined fibre length.

While the broadest form of the present invention relates to the use of petioles from any plant, it will be appreciated that certain types of plants are likely to form petioles of more practical use than others. For example, a relatively small plant may form petioles that are too small (either in length or in width) to allow processing in a suitable or economic manner, or may have an insufficiently sized pulvinus (basal enlargement) to produce an "outer portion" of the type described above in relation to the pseudostem of banana plants. With this in mind, it will be appreciated that the present invention is not directed to a product utilising only the stalk or midrib portion of a petiole.

It should also be appreciated that the above reference to the fibre furnish of the present invention "consisting essentially of" plant petiole tissue, is a reference to the intention that the fibre furnish contain fibres derived only from plant petiole tissue. However, with any natural product derived from plants, a skilled addressee will understand that there is likely to be some degree of contamination (or undesirable material) that cannot be avoided, hence the use of the term "consisting essentially of" to make clear that the presence of such contamination is not to be excluded.

It is envisaged that the most suitable form of plant petiole for use with the present invention will be the petioles from banana plants in the family Musaceae. Exemplary banana plants within the family Musaceae include the genera *Musa* and *Enseta*. Although not to be limited thereto, the following description of the present invention will thus predominantly relate to its use in producing fibre furnish from the pseudostem of edible-fruited banana plants, such as those belonging to the species *Musa acuminata* (such as the well known bananas "Cavendish" and "Lady Finger"), *Musa balbisiana*, or to the hybrids *Musa paradisiaca* (often referred to as "plantain") and *Musa sapientum*.

The petioles from banana plants have substantially longitudinally aligned fibres. In terms of the morphological features of the petiole that make it beneficial for use in the present invention, various aspects will now be briefly described.

First, the petiole is not straight, but has a gentle ventral curvature. Second, the stalk of the petiole is not circular but is U-shaped in cross section with the channel on its upper surface, with the leaf emerging from the upper arms of the U. Third, the leaf is joined to the stalk by numerous parallel fibrous veins that run along the petiole before diverging through the leaf.

Also, the outer layers of tissue are reinforced longitudinally by vascular bundles of fibres which include xylem. Internally, however, the structure is pierced by large air canals that are separated by narrow longitudinal parenchyma partitions that contain very few vascular bundles, which in turn are joined at small intervals by single transverse layers of porous stellate parenchyma. These petiole structures are thus not hollow nor solid, but are semi-hollow with a very ordered structure, with quite significant alignment of the longitudinally extending fibre bundles. It is thus in this complex morphological configuration that reference is being made throughout this patent specification to plant petiole fibres that are "substantially longitudinally aligned".

In a preferred form, the plant petiole tissue will be in the form of substantially longitudinally aligned petiole fibres from banana plants in the family Musaceae including the genera *Musa* and *Enseta*. More preferably, the plant petiole tissue will be in the form of substantially longitudinally aligned petiole fibres from edible-fruited banana plants, including those belonging to the species *Musa acuminata* (such as the well known bananas "Cavendish" and "Lady Finger"), *Musa balbisiana*, or to the hybrids *Musa paradisiaca* (often referred to as "plantain") and *Musa sapientum*.

In a preferred form, the petiole fibres will have been cut generally laterally such that the fibres have a narrow fibre length distribution such that at least 95% of the fibres in the fibre furnish have substantially the same length, the length being in the range of from about 1.0 mm to about 12.0 mm, or more. Indeed, in a preferred form, the petiole fibres will have been cut such that the predetermined fibre length in the fibre furnish will be such as about:

- 1.0 mm to 2.0 mm in order for the fibre furnish to be a raw material for fine printing and writing paper grades;
- 3.0 mm to 4.0 mm for newsprint, tissue and some packaging grades of paper;
- 4.0 mm to 6.0 mm for packaging grades where high strength is desirable, or where the fibre furnish is for use in the manufacture of panel boards or medium density fibre boards;
- 7.0 mm to 12.0 mm for various other uses such as floor base panels, wall and ceiling panels, and the like; or
- above 12.0 mm, such as to about 100 mm, for products such as oriented strand board (OSB) that typically utilise larger strands (flakes or wafers) of wood fibres in the equivalent 'engineered wood' form.

In a preferred form, at least 98% of the fibres in the fibre furnish will have substantially the same predetermined fibre length mentioned above.

Indeed, in a preferred form, a method and/or apparatus for use in producing fibre furnish in accordance with the present invention will utilise a petiole fibre cutting method step and/or apparatus element that permits the generation of fibres in increments across the full range across the full range of predetermined fibre lengths from about 1.0 mm to about 12.0 mm, such as for example 0.1 mm increments, 0.5 mm increments or 1.0 mm increments. In this respect, a skilled addressee will appreciate that a reference to "about" 1.0 mm or "about" 3.0 mm, for example, is to permit a normal variation from "precisely" 1.0 mm or "precisely" 3.0 mm, depending upon the end use requirements and the precision possible with whatever method step and/or apparatus element is adopted in producing the paper furnish.

It is envisaged that this normal variation is not likely to be more than 10% away from the increments, and so should be regarded to include a variation of, for example, ±0.1 mm for a 1.0 mm increment. Indeed, it will also be appreciated that the above reference to the fibres each having substantially the same length should also permit a similar degree of variation away from the predetermined length.

With respect to the beneficial uses of the fibre furnish of the present invention, it has been found that the reasonably ordered arrangement of the fibres provides many benefits for products made therefrom. For example, it is known that most of the engineered woods mentioned above (such as particle board and MDF) have fibres arranged randomly throughout with the fibres being bound together by an adhesive resin. Although the resin and fibres are generally compressed upon manufacture, there usually still remains at least some void space that the resin does not fill, which is often desirable in products of this type to reduce their density (and their weight). However, this has obvious strength implications.

To the contrary, by utilising the substantially longitudinally aligned petiole fibres, and by producing the fibre furnish by cutting those fibres generally laterally to form fibres in a narrow fibre length distribution, the fibres in the furnish of the present invention can be arranged in quite an ordered manner (with at least large portions of the fibres being in bundled fibres arranged in parallel and perpendicularly to other bundled fibres) in products of the type of particle board and MDF. Indeed, it has been found that such a reasonably ordered arrangement results in improved strength (and other properties) compared with traditional random fibre arrangements in products of the same type, often resulting in thinner and lighter products being possible when utilising the fibre furnish of the present invention.

Further still, a fibre furnish produced from the preferred source of banana plant pseudostems are known to have improved waterproofing and fire retardant properties, these properties additionally resulting in products with improved properties compared to traditional engineered wood products. Indeed, while traditional engineered wood products may be provided with such improved properties (such as increased resistance to water) it would generally only be after those traditional products undergo further treatment or additional steps during manufacture.

In one form of the present invention, the substantially longitudinally aligned petiole fibres may be obtained from the plant petiole tissue by a process that removes sheets of fibres from the outer portion of a pseudostem by virtue of separation between bundles of fibres (about the periphery of the pseudostem), ideally as the pseudostem is rotated. This allows for separation in a manner that retains the integrity of the fibre bundles along virtually the entire length of the pseudostem and thus along a continuously removed sheet.

In the most preferred form, the substantially longitudinally aligned petiole fibres may be obtained from the plant petiole tissue by the process for removing sheets of fibres from the outer layer of a pseudostem as is described in the abovementioned International patent publication WO 2006/029469 (Papyrus Australia Limited), the entire contents of which are hereby incorporated by reference for the purpose of describing an ideal sheet removal process.

For example, an ideal process for producing sheets from the pseudostems of banana plants in the family Musaceae will preferably include the steps of feeding a pseudostem into a workstation, supporting the pseudostem for rotation thereof about its longitudinal axis within the workstation, and contacting the rotating pseudostem along substantially its entire length with a fibre-separating device, such that a continuous sheet of fibre is removed from the pseudostem by the fibre-separating device during rotation. In the preferred form of the present invention, sheets are removed in this manner only as far as the core of the pseudostem. The fibres of the core are, for the purposes of the present invention, not regarded as petiole fibre and are thus not desired for use in the fibre furnish of the present invention.

Sheets produced in this manner are thus continuous sheets removed peripherally from the pseudostems, much as one would peel a layer of paper off a toilet roll. The sheets are continuous in that they are preferably as wide as the pseudostem is long, and they are preferably only as long as is manageable for their subsequent handling. Of course, they will also only be as long as is feasible given the diameter of a particular pseudostem and the desired thickness of the sheet.

Once such sheets of substantially longitudinally aligned petiole fibres have been removed from the pseudostem, the fibres of the sheets may then be cut generally laterally to a required fibre length. In a preferred form, the cutting process is undertaken with a cutting device that is able to receive the removed sheets and pass them through an arrangement of either low or high speed cutting discs in the form of cutting blades or grinders set to a specific cutting width, and operating so as to cut the substantially longitudinally aligned petiole fibres generally laterally (and ideally at an angle within the range of 85° to 95°, and more preferably at about 90°) to the cutting discs. The cutting device thus produces strips of parallel fibres of substantially the same length.

Preferably, the cutting device additionally includes a further cutting mechanism arranged so as to further cut or separate the parallel fibres perpendicularly to the above generally lateral cut, thus further cutting the strips of parallel fibres into fibre segments. These fibre segments may then be in a useful form for subsequent processing as described below.

The fibre segments produced in such a preferred sheet removal and cutting process are therefore in a form where they can be pressed to a moisture content of 20% to 90%, stacked to create a "bale", and be wrapped and strapped for distribution as fibre furnish to, for example, a mill. Alternatively, the fibre segments produced in such a preferred sheet removal and cutting process can be slurried and formed on a filter system to create a wet fibrous mat, pressed and transported through a drying station to produce a sheet of fibre with a moisture content of about 10% to 15%, and subsequently baled and distributed in the manner described above.

The present invention additionally provides an apparatus for producing a fibre furnish for use in the manufacture of (amongst other things) paper and paper-based products, the apparatus including means for removing substantially longitudinally aligned plant petiole fibres from a plant, and means for cutting the removed fibres generally laterally to form a fibre furnish with a fibre length distribution such that at least 95% of the fibres have substantially the same predetermined fibre length.

In a preferred form, the apparatus includes a sheet removal device that removes sheets of fibres from the outer portion of a pseudostem by virtue of separation between bundles of fibres, as the pseudostem is rotated. Additionally, the apparatus preferably includes a workstation for feeding a pseudostem thereinto, a support member for supporting the pseudostem for rotation thereof about its longitudinal axis within the workstation, and a fibre-separating device for contacting the rotating pseudostem along substantially its entire length such that a continuous sheet of fibre is removed from the pseudostem by the fibre-separating device during rotation. Indeed, in a more preferred form, the apparatus will generally be such as is described in the abovementioned International patent publication WO 2006/029469 (Papyrus Australia Limited).

Furthermore, and as mentioned above, the apparatus preferably includes a cutting device wherein the substantially longitudinally aligned petiole fibres can be cut generally laterally, the cutting device being in the form of an arrangement of either low or high speed cutting discs in the form of cutting blades or grinders set to a specific cutting width.

The present invention additionally provides a method for producing a fibre furnish for use in the manufacture of (amongst other things) paper and paper-based products, the method including removing substantially longitudinally aligned plant petiole fibres from a plant, and cutting the removed fibres generally laterally to form a fibre furnish with a fibre length distribution such that at least 95% of the fibres have substantially the same predetermined fibre length.

In a preferred form, the method includes obtaining the substantially longitudinally aligned petiole fibres by a process that removes sheets of fibres from the outer portion of a pseudostem by virtue of separation between bundles of fibres, as the pseudostem is rotated. Indeed, the sheet removal process preferably allows for separation in a manner that retains the integrity of the fibre bundles along virtually the entire length of the pseudostem and thus along a continuously removed sheet.

In a more preferred form, the sheet removal process includes the steps of feeding a pseudostem into a workstation, supporting the pseudostem for rotation thereof about its longitudinal axis within the workstation, and contacting the rotating pseudostem along substantially its entire length with a fibre-separating device, such that a continuous sheet of fibre is removed from the pseudostem by the fibre-separating device during rotation. Indeed, in the most preferred form, the method for removing the substantially longitudinally aligned plant petiole fibres from a plant will be a method such as that described in the abovementioned International patent publication WO 2006/029469 (Papyrus Australia Limited).

Furthermore, and as mentioned above, the method preferably includes cutting the substantially longitudinally aligned petiole fibres generally laterally with a cutting device in the form of either low or high speed slitters or cutting discs, or an array of shredders having cutting blades or grinding wheels, set to a specific cutting width.

While it is envisaged that most embodiments of the method and apparatus of the present invention will see the removal method and means operating sequentially with the cutting means, so that removal occurs prior to cutting, it is of course possible for cutting to occur prior to removal (even though the reference to removal from the plant would then not necessarily be entirely accurate).

The fibre furnish of the present invention can thus be added to a pulp and/or paper maker's furnish at a point in their system that would suit their needs, and in any proportion as is desired. In most cases, it is envisaged that the fibre furnish of the present invention would be used as is, but in order to reach certain paper making parameters it is possible that some refining of the fibres of the fibre furnish would take place at a mill.

For example, where there is a need to whiten the fibres prior to use, the mill will need to add the fibre furnish at a point up stream of their bleaching lines. Where there is no need to whiten the fibres, then the mill could add the fibre furnish closer to their stock preparation process. Bleached (whitened) fibres would be used in printing, writing and some tissue grades, as well as some packaging grades. Unbleached fibres would be used typically in non printing/writing grades.

Of course, it will be appreciated that the fibre furnish of the present invention can also be used in conjunction with furnish from other sources and of other types, in a variety of proportions as desired. It will also be appreciated that the fibre furnish of the present invention could be used with one or more of a wide variety of known paper-making additives and modifiers, again as desired, or could be manipulated in a known manner (such as by mechanical agitation) if considered desirable in certain situations.

BRIEF DESCRIPTION OF THE DRAWINGS

An embodiment will now be at least partially described, by way of example only, with particular reference to exemplary apparatus that can be used to form the fibre furnish of the present invention. However, it is to be appreciated that the following description of the accompanying drawings only exemplifies one particular way of putting the present invention into practise. The following description is thus not to be read as limiting the above general description.

In the accompanying drawings.

DETAILED DESCRIPTION OF THE PREFERRED EMBODIMENT

Figure 2A:
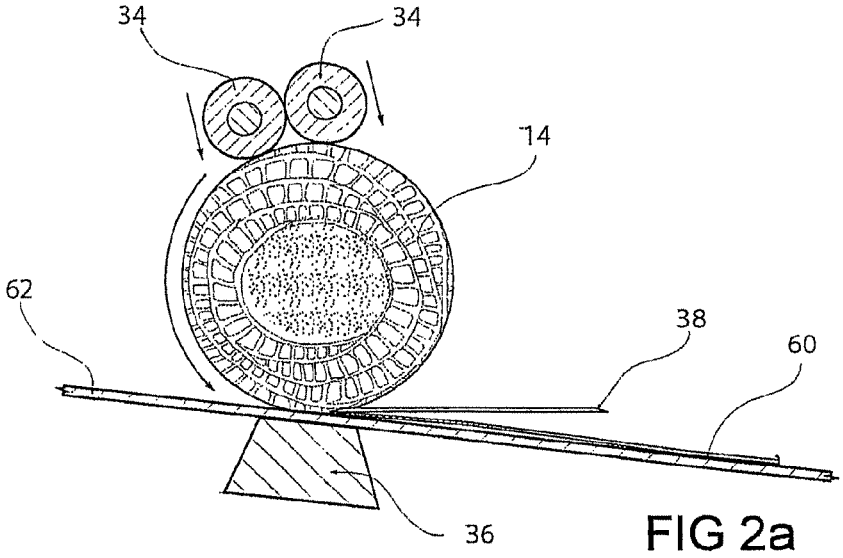
FIGS. 2*a*, 2*b* and 2*c* are successive operational views of a pseudostem in an apparatus capable of removing sheets of substantially longitudinally aligned petiole fibres, showing the diameter of the pseudostem reducing as sheets are removed.
Figure 2B:
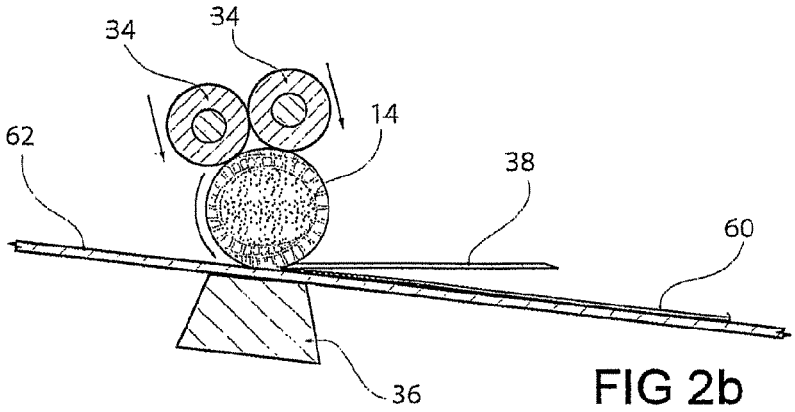

Before turning to a more detailed description of the apparatus illustrated in FIGS. 2*a* and 2*b*, it is helpful to firstly illustrate various aspects of a preferred form of raw feed material for the subject of this invention. Indeed, and as mentioned above, it is envisaged that the most suitable form of plant petiole for use with the present invention will be the petioles from banana plants in the family Musaceae including the genera *Musa* and *Enseta*.

Figure 1A:
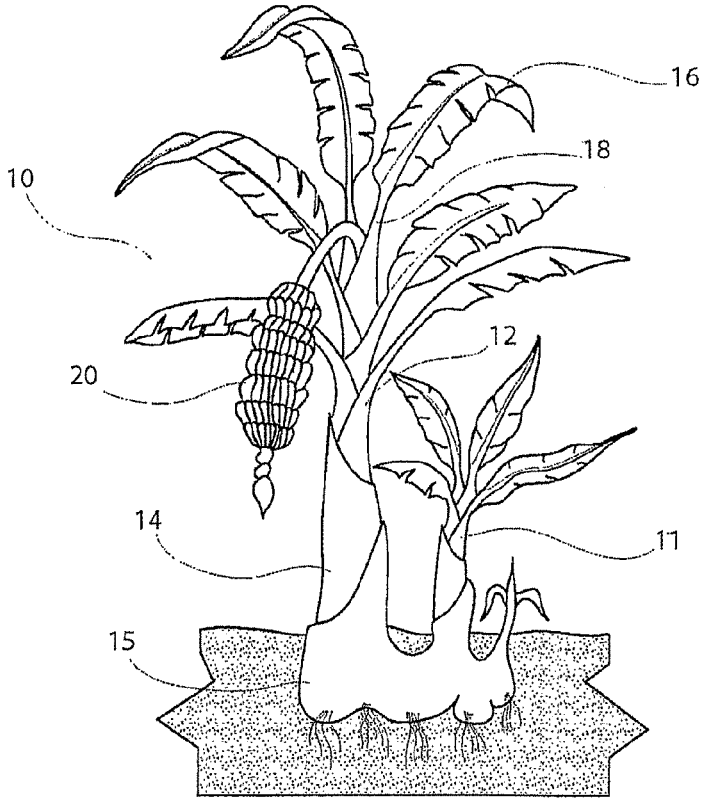
FIG. 1*a* is a schematic side view of a typical banana plant.

FIG. 1*a* thus shows a typical banana plant 10 (with a sucker 11), being a large perennial herb with petioles having long overlapping pulvini (basal enlargements) 12 that extend into stalks (or midribs) 18 having tender, smooth, fleshy-stalked leaves 16 arranged spirally therearound. The long overlapping pulvini 12 form the outer portion of a stout, trunk-like pseudostem 14, through the centre of which the terminal inflorescence grows, forming an inner portion often referred to as a core 21 (see FIG. 1*b*). Each pseudostem 14 grows from a bud on the corm 15, which is an underground rhizome. The banana plant 10 can grow to heights normally in the range of 3 to 8 meters over a 9 to 18 month period.

Figure 1B:
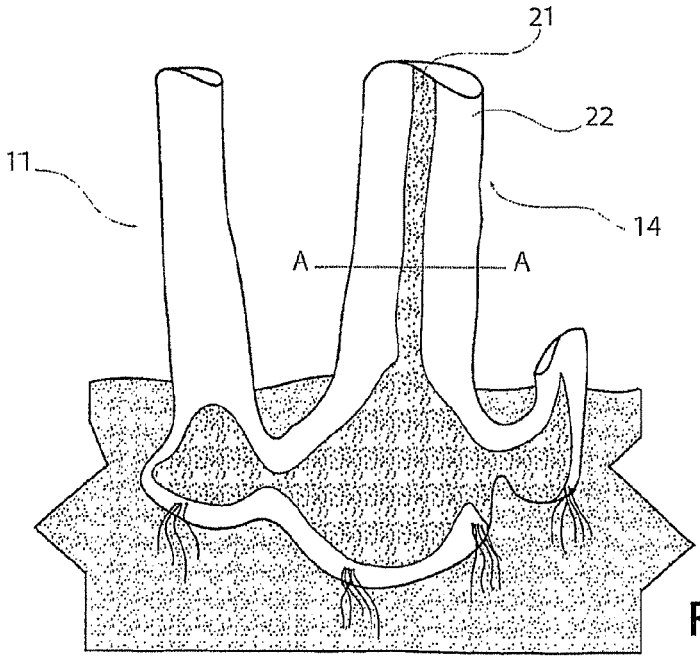
FIG. 1*b* is a section through the base of the pseudostem of the banana plant in FIG. 1*a;*

The inflorescence is a terminal spike emerging from the core 21 of the pseudostem 14 as illustrated in FIG. 1*b*. As the young fruits develop from the female flowers, they appear as green slender fingers. The bracts then shed and the fully-grown fruits in each cluster become a 'hand' of bananas 20, with the stalk drooping until the bunch hangs upside down.

Figure 1C:
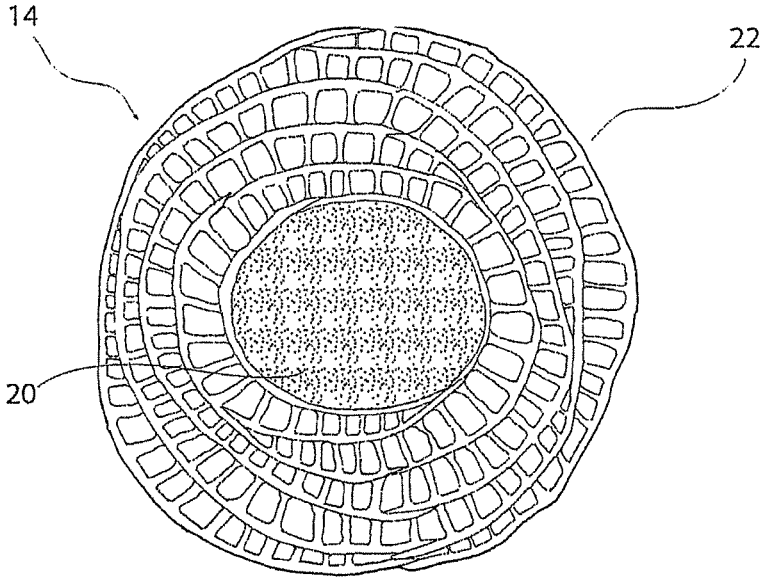
FIG. 1*c* is a section through line A-A of the pseudostem in FIG. 1*b;*
Figure 1D:
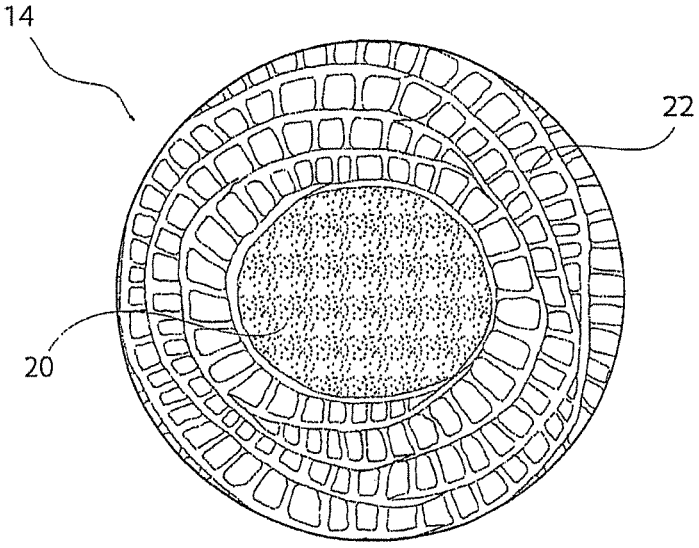
FIG. 1*d* is the same section as FIG. 1*c*, but after the psuedostem has been rounded-up.

The pseudostem 14 of a mature plant has an outer layer 22 that is formed by the overlapping pulvini of the petioles (and also with some overlap of the stalks of the petioles) as the plant grows, that is distinct from the core 21, as is evident from the typical section of a raw pseudostem 14 (before a round-up process) illustrated in FIG. 1*c*. As can also be seen in FIG. 1*b*, an immature pseudostem (such as sucker 11) does not yet have a core and thus is entirely formed from this petiole material.

The petioles from banana plants have substantially longitudinally aligned petiole fibres. In terms of the morphological features of a petiole that make it beneficial for use in the present invention, various aspects are apparent from FIGS. 1(*c*) and 1(*d*). The outer layer 22 of tissue is reinforced longitudinally by vascular bundles which include xylem. Internally of the outer layer 22, the structure is pierced by large air canals that are separated by narrow longitudinal parenchyma partitions that contain very few vascular bundles, which in turn are joined at small intervals by single transverse layers of porous stellate parenchyma. This outer layer structure 22 is thus not hollow nor solid, but is semi-hollow with a very ordered structure, with quite significant alignment of the longitudinally extending fibre bundles.

It is thus in this complex morphological configuration that reference is being made throughout this patent specification to plant petiole fibres that are "substantially longitudinally aligned", and particular reference to the outer layer 22 is intended. In this respect, it should be noted that the differing morphological configuration and chemical composition of the inflorescence material that makes up the core 21 of the plant is undesirable for use in the fibre furnish of the present invention and thus is preferably avoided.

Commercially planted banana plants typically only have 1 to 2 year life spans, as banana plants only flower (and produce bananas) once, following which the leaves, leaf stalks and pseudostem start to die. The pseudostem may then be used in a method such as that of the present invention.

Once the fruit have been removed from a banana plant, its pseudostem is available for use. Ideally, each pseudostem will be cut to a suitable length, and will undergo a pre-processing step that has been referred to above as a "round-up step". For present purposes, the pre-processing can be conducted in the same manner, and with the same method and apparatus as the subsequently described primary processing step, and thus this description will now turn to a description of a single apparatus and its method of operation.

Turning now to a discussion of FIGS. 2*a* and 2*b*, these figures show sequentially the general operation of an apparatus 28 in terms of a pseudostem 14. In terms of its operation, the apparatus 28 includes a fibre-separating device in the form of a longitudinally moving blade 38 that is configured and constrained so as to move substantially parallel to the longitudinal axis of the pseudostem 14, along its entire length, in a single pass. These figures have been adopted from the above-mentioned International patent publication WO 2006/029469 (Papyrus Australia Limited), the entire contents of which are hereby incorporated by reference for the purpose of describing such an ideal sheet removal apparatus and process.

FIG. 2*a* shows the pseudostem 14 having a diameter of about 150 mm, which is a typical starting diameter for a rounded-up pseudostem fed into a workstation. FIG. 2*b* shows the pseudostem 14 after it has been operated upon for some time, and after a continuous sheet 60 has been separated therefrom, the pseudostem 14 now having a reduced diameter of about 75 mm. Also shown in FIGS. 2*a* and 2*b* is a conveyor belt 62 upon which the pseudostem 14 will rest, supported thereunder by a support member 36. Upper support rollers 34 are also evident.

Figure 2C:
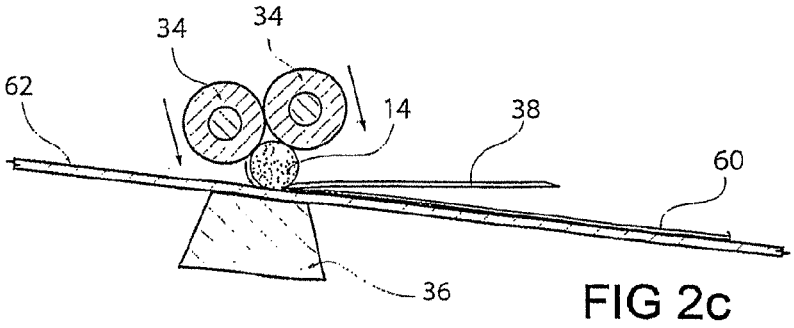
Figure 3A:
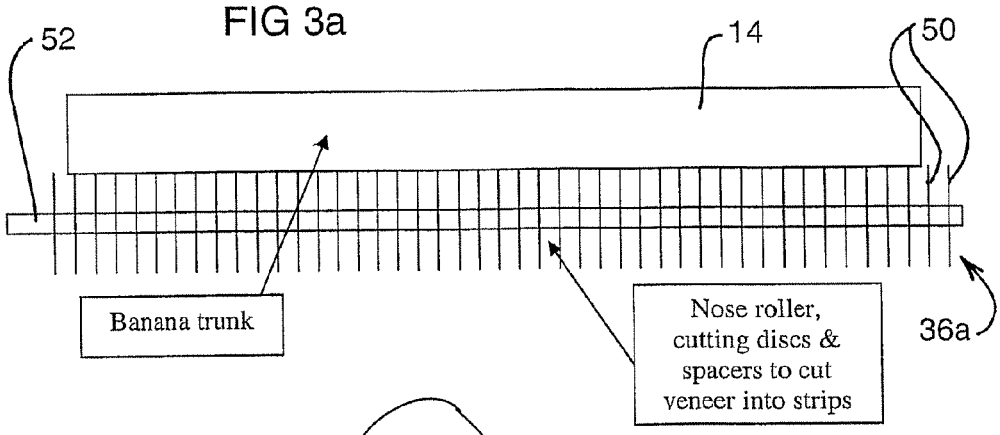
FIGS. 3*a* and 3*b* are schematic illustrations of one form of apparatus suitable for receiving those sheets of substantially longitudinally aligned petiole fibres and producing the fibre furnish of the present invention therefrom.
Figure 3B:
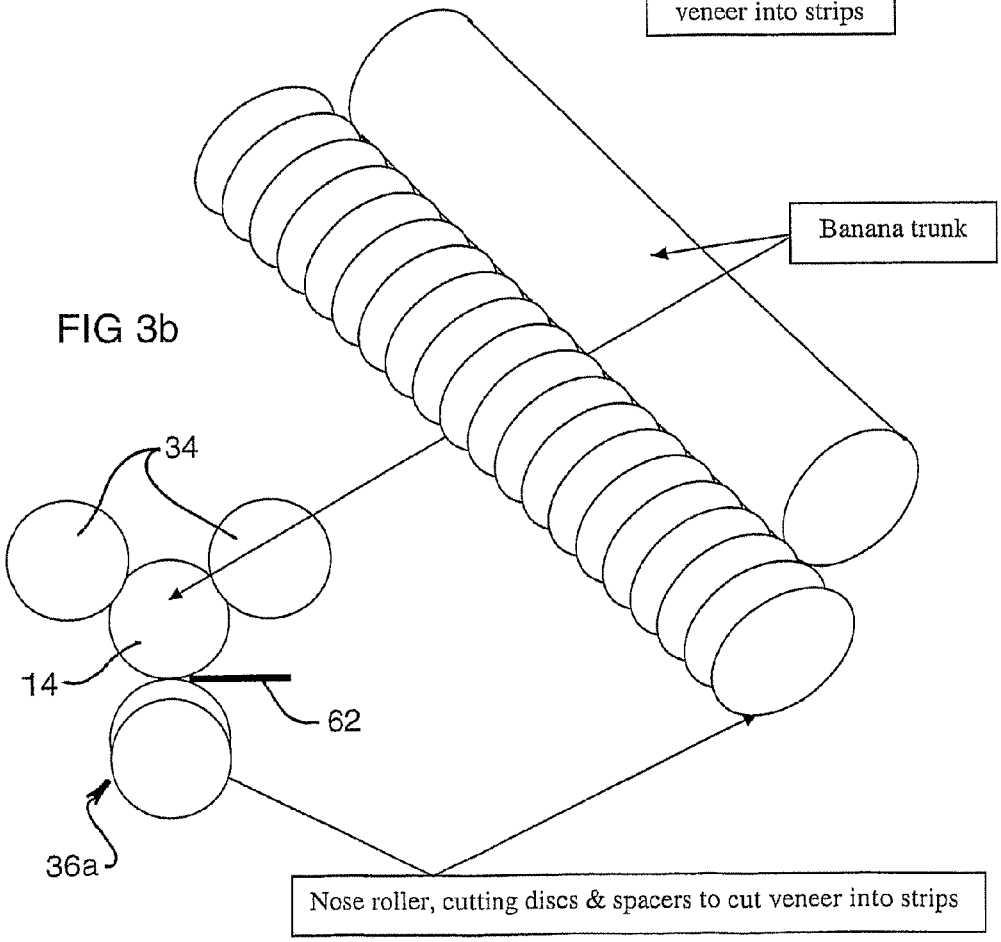

Illustrated in FIGS. 3*a* and 3*b* is a modification to the apparatus of FIGS. 2*a*, 2*b* and 2*c*, where the support member 36 is replaced by a support roller 36*a* in the form of a nose roller including a plurality of very thin cutting discs 50 (or very thin grinding wheels) spaced along a shaft 52 at regular intervals, the intervals being representative of the predetermined fibre length mentioned above. In this form, and as is evident in the schematic of FIG. 3*b*, the sheet being removed from the pseudostem 14 upon the conveyor belt 62 is thus able to be cut generally laterally to form strips of longitudinally aligned fibres with the predetermined fibre length set by the intervals between the cutting discs 50.

The strips may then be transported in that form, as fibre furnish, for subsequent use in paper making or the like, or the strips may be subsequently processed to further separate the longitudinally aligned fibres into smaller packets or bundles of fibres, or into individual fibres loosely arranged, as desired.

The cutting discs 50 are rotated either at a surface speed similar to the line speeds of the apparatus of FIGS. 2*a*, 2*b* and 2*c*, or in the case of the use of (non-sharp) grinding wheels at a much higher speed to that line speed.

It will also be appreciated that the cutting discs 50 can either run on a slotted corresponding base plate (not shown) and/or on a corresponding female slotted roller (not shown) and/or a rubber/plastic roller (also not shown). Of course, it will also be appreciated that the cutting discs 50 could be replaced with any suitable type of cutting mechanism that can achieve the same form of generally lateral cut, in a manner that permits the length of the fibre to be predetermined (and thus "dialled up"), such as a cutting mechanism that utilises suitably arranged tension wires and/or blades reciprocating at 90 degrees to the direction of movement of the sheet. In other forms, the cutting mechanism may include water jets or lasers to provide the cutting function.

Figure 4A:
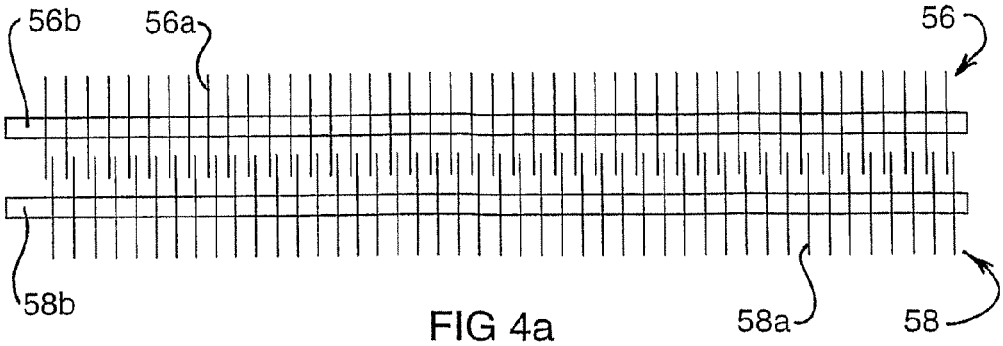
FIGS. 4*a* and 4*b* are schematic illustrations of another form of apparatus suitable for receiving those sheets of substantially longitudinally aligned petiole fibres and producing the fibre furnish of the present invention therefrom.
Figure 4B:
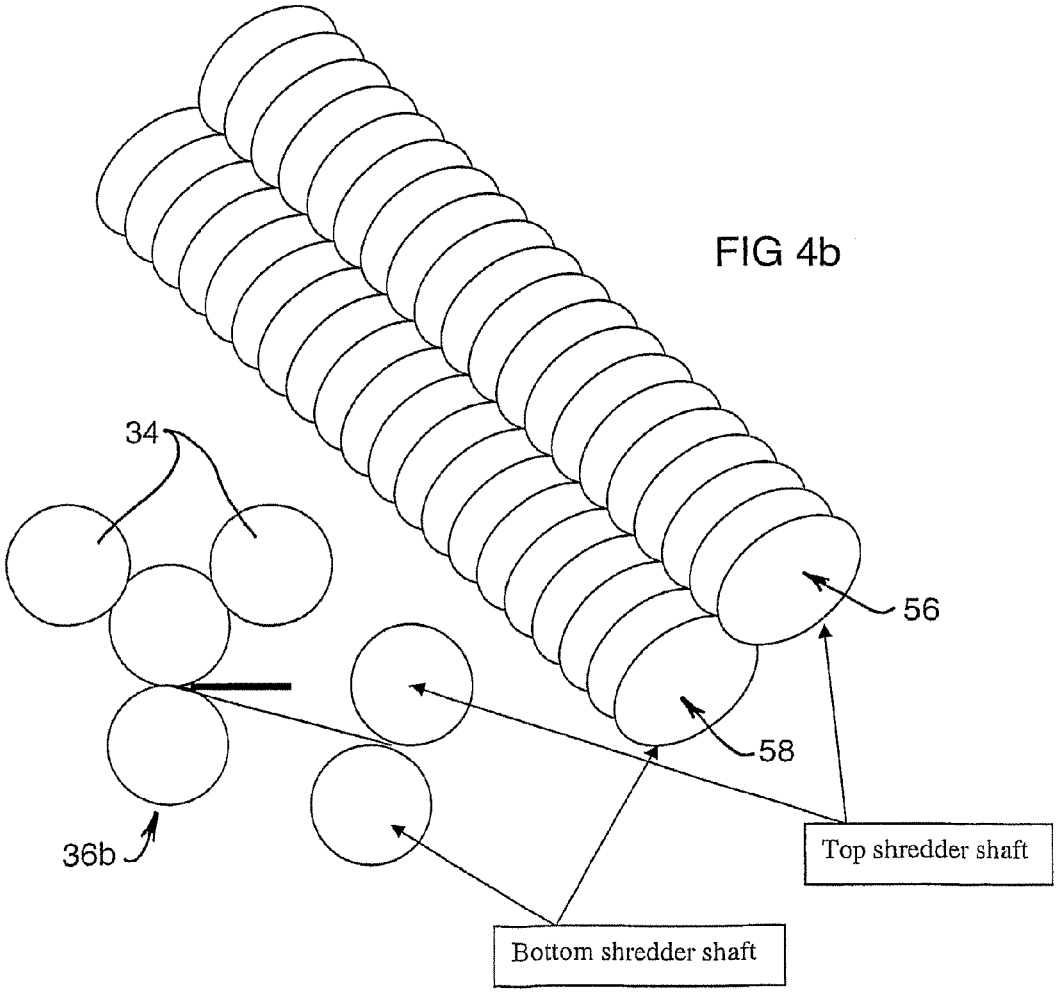

Illustrated in FIGS. 4*a* and 4*b* is a further modification to the apparatus of FIGS. 2*a*, 2*b* and 2*c*, where the support member 36 is replaced by a support roller 36*b* having a similar form to the upper rollers 34, with the conveyor belt 62 being bypassed by the sheet produced therefrom to be passed directly to a shredder arrangement that includes a top shredder shaft 56 and a bottom shredder shaft 58, each having a plurality of cutting discs 56*a* and 58*a* spaced along their respective shafts 56*b* and 58*b* at regular intervals. In this form, it is the space between adjacent discs 56*a* and 58*a* that is representative of the predetermined fibre length mentioned above.

In this form, and as again as is evident in the schematic of FIG. 4*b*, the sheet being removed from the pseudostem 14 below the conveyor belt 62 is again thus able to be cut generally laterally to form strips of longitudinally aligned fibres with the predetermined fibre length.

It is envisaged that operation of a method and apparatus such as is evident from the above description will produce fibre furnish with the narrow fibre length distribution preferred and with a predetermined fibre length in the range of from about 1.0 mm to about 12.0 mm, the fibre length being dependent upon (in these embodiments) the spacing between the respective cutting discs.

Figure 5:
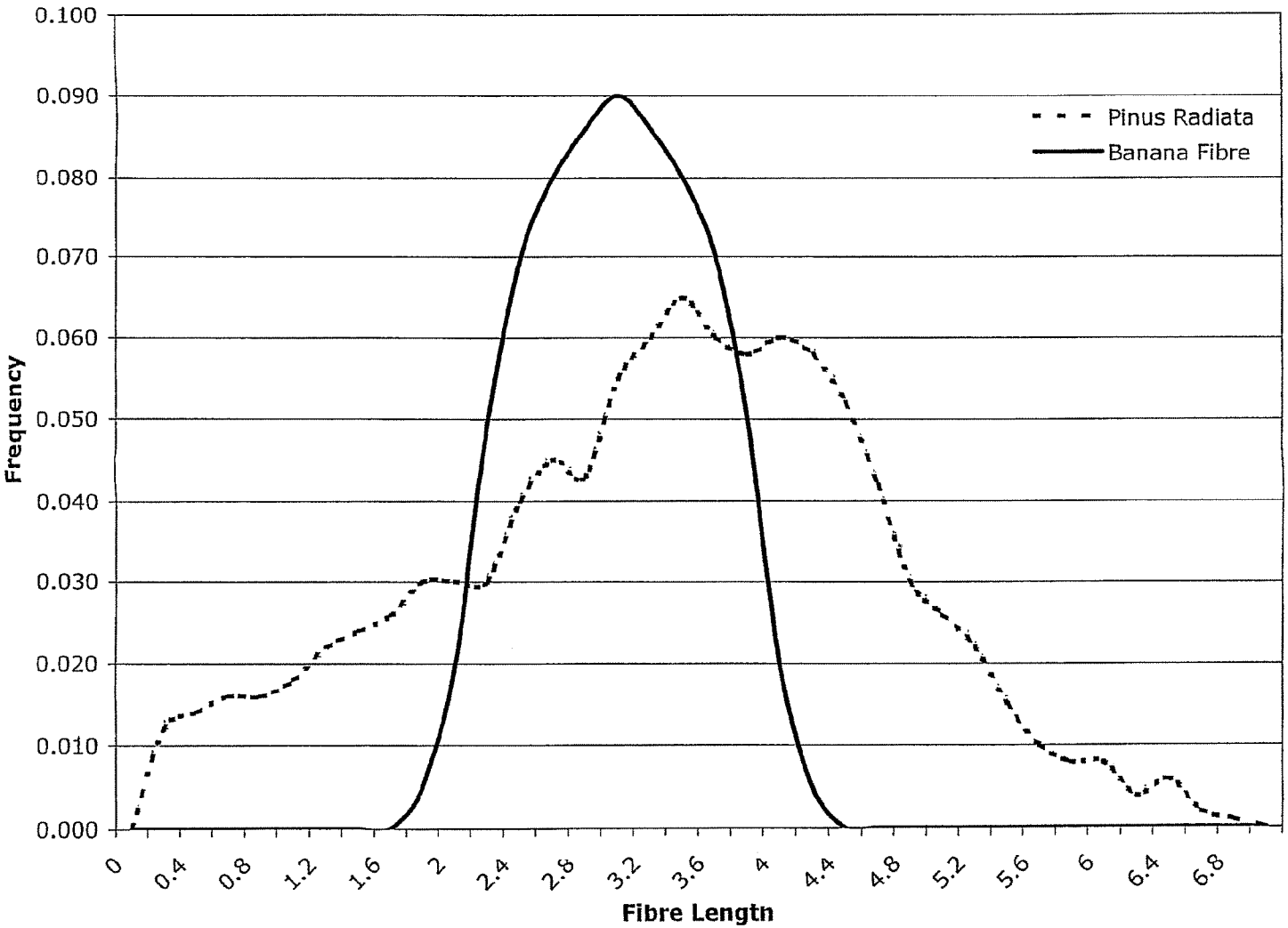
FIG. 5 is an example of a distribution curve that is envisaged to be obtainable in the fibre furnish of the present invention, showing the narrow fibre length distribution that is achievable compared to the much broader fibre length distribution for a commercially available furnish from pinus radiate.

With this in mind, reference is made to FIG. 5 that is a distribution curve showing the proportion of fibres in a prophetic sample of fibre furnish in accordance with the present invention (referred to in the figure as "Banana Fibre"), which shows that greater than about 95% of the sample is within a range of about two standard deviations from the predetermined (and targeted) fibre length of 3.1 mm. Indeed, it can be seen that the comparative fibre from pinus radiata includes relatively large volumes of fibres in a far broader standard deviation range, and includes a substantial volume of fibres having lengths as low as 0.2 mm and as high as nearly 7.0 mm.

Figure 6:
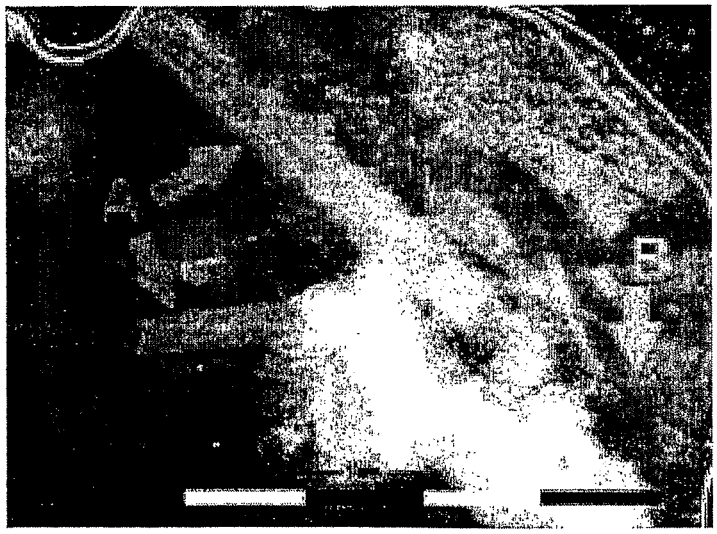
FIG. 6 is a photomicrograph of fibre furnish produced in accordance with the present invention.

Reference is also made to FIG. 6 which is a photomicrograph of fibre furnish produced in the manner described above from the outer region of a banana pseudostem. The photomicrograph shows: (A) a mix of un-disintegrated bundles and sheets of fibres that have been cut so as to be 5.0 mm in length; and (B) non-fibrous tissue (parenchyma). The scale sections in the photomicrograph are marked at 1.0 mm, and it was found that about 95% of the fibre was within about 10% of the desired 5.0 mm size range. The methods used to analyse the fibre length were microscopy and fractionation via a Bauer McNett Fibre Fractionator.

Finally, it will be appreciated that in the fibre furnish of the present invention it is possible to generate fibres (or fibre bundles) with preferred geometries, which can give rise to significant advantages. Indeed, by controlling the thickness of the sheets being removed from the pseudostem to, say, about 6.0 mm, and by using cutting discs with an interval of about 6.0 mm, with a subsequent fibre bundle separation technique to separate bundles also of about 6.0 mm, it is possible to form fibre bundles (which might be referred to as "chips", using a common term from the engineered wood art), that are approximately cubic with dimensions of 6.0×6.0×6.0 mm.

When such "chips" are compressed to form a board, it has been found that they tend to fill all gaps and the edges of a mould, therefore reducing the amount of glue necessary and increasing the strength of the bond given that the contact surface has been maximised. Also, uniform characteristics are provided for virtually the entire board without the need for edge trimming and/or surface preparation/sanding.

Finally, it will be appreciated that this embodiment has been described by way of example only, and that variations and modifications within the spirit and scope of the invention are also envisaged.

The invention claimed is:

1. Fibre furnish for use in the manufacture of paper and paper-based products, the fibre furnish consisting essentially of generally laterally cut, substantially longitudinally aligned, fibres of plant petiole tissue from banana plants in the family Musaceae, the fibres having a fibre length distribution such that at least 95% of the fibres have substantially the same predetermined fibre length wherein the predetermined fibre length is in the range of about 1.0 mm to 12.0 mm.

2. Fibre furnish according to claim 1, wherein at least 98% of the fibres have substantially the same predetermined fibre length.

3. Fibre furnish according to claim 1, wherein the plant petiole tissue is from the pseudostem of edible-fruited banana plants.

4. Fibre furnish according to claim 1, wherein the predetermined length is in the range of from about 1.0 mm to about 2.0 mm.

5. Fibre furnish according to claim 1, wherein the predetermined length is in the range of from about 3.0 mm to about 4.0 mm.

6. Fibre furnish according to claim 1, wherein the predetermined length is in the range of from about 4.0 mm to about 6.0 mm.

7. Fibre furnish according to claim 1, wherein the predetermined length is in the range of from about 7 mm to 12 mm.

8. Fibre furnish according to claim 1, wherein the substantially longitudinally aligned petiole fibres are obtained from the plant petiole tissue of banana plants in the family Musaceae, by a process that removes sheets of fibres from the outer portion of a pseudostem by virtue of separation between bundles of fibres, as the pseudostem is rotated.

9. Fibre furnish according to claim 8, wherein the sheet removal process allows for separation in a manner that retains the integrity of the fibre bundles along virtually the entire length of the pseudostem and thus along a continuously removed sheet.

10. Fibre furnish according to claim 8, wherein the sheet removal process includes the steps of feeding a pseudostem into a workstation, supporting the pseudostem for rotation thereof about its longitudinal axis within the workstation, and contacting the rotating pseudostem along substantially its entire length with a fibre-separating device, such that a continuous sheet of fibre is removed from the pseudostem by the fibre-separating device during rotation.

11. Fibre furnish according to claim 1, wherein the substantially longitudinally aligned petiole fibres have been cut by a cutting process undertaken with a cutting device in the form of either low or high speed slitters or cutting discs, or an array of shredders having cutting blades or grinding wheels, set to a specific cutting width.

12. Fibre furnish according to claim 11, wherein the substantially longitudinally aligned petiole fibres are oriented at an angle within the range of 85° to 95° to the cutting device.

13. Fibre furnish according to claim 12, wherein the substantially longitudinally aligned petiole fibres are oriented at an angle of about 90° to the cutting device.

* * * * *